United States Patent [19]

Karas et al.

[11] Patent Number: 4,646,930

[45] Date of Patent: Mar. 3, 1987

[54] BOTTOM PROFILE FOR A SEAMLESS CONTAINER BODY

[75] Inventors: Richard J. Karas, Addison; Gerald G. Echternach, Barrington, both of Ill.

[73] Assignee: American Can Co., Greenwich, Conn.

[21] Appl. No.: 388,673

[22] Filed: Jun. 16, 1982

Related U.S. Application Data

[63] Continuation-in-part of Ser. No. 120,399, Feb. 11, 1980, abandoned.

[51] Int. Cl.[4] ..... B65D 1/16; B65D 1/26; B65D 1/42

[52] U.S. Cl. ..... 220/70; 206/508; 220/66

[58] Field of Search ..... 220/5 R, 66, 70, 72, 220/DIG. 22; 206/503, 509, 454, 458

[56] References Cited

U.S. PATENT DOCUMENTS

| | | | |
|---|---|---|---|
| 998,490 | 7/1911 | Fitch | 220/70 X |
| 3,272,383 | 9/1966 | Harvey | 220/70 X |
| 3,279,640 | 10/1966 | Dodson | 220/5 R |
| 3,904,069 | 9/1975 | Tankmanian | 220/70 X |
| 3,912,109 | 10/1975 | Essex, Jr. et al. | 220/66 |
| 3,979,009 | 9/1976 | Walker | 220/66 |
| 4,054,227 | 10/1977 | Saunders | 426/131 X |
| 4,120,419 | 10/1978 | Saunders | 220/66 |

FOREIGN PATENT DOCUMENTS

| | | | |
|---|---|---|---|
| 992475 | 7/1976 | Canada | 220/70 |
| 2308554 | 11/1976 | France | 220/70 |
| 1533057 | 11/1978 | United Kingdom | 220/458 |

*Primary Examiner*—Allan N. Shoap
*Attorney, Agent, or Firm*—Paul R. Audet; Warren N. Low

[57] ABSTRACT

A bottom profile for a cylindrical two-piece drawn steel can is configured during manufacture so that the resultant bottom profile shape includes areas of highly worked metal positioned to assume processing stresses. A bottom wall bead is included and has a prescribed cross-sectional configuration to provide maximum abuse resistance and to be functionally and operationally interchangeable in the packing and processing line with traditional three-piece containers. Moreover, the prescribed bead configuration works to improve stacking crush resistance by work hardening the metal adjacent the corner between the bottom and wall of the can.

5 Claims, 8 Drawing Figures

FIG. 3
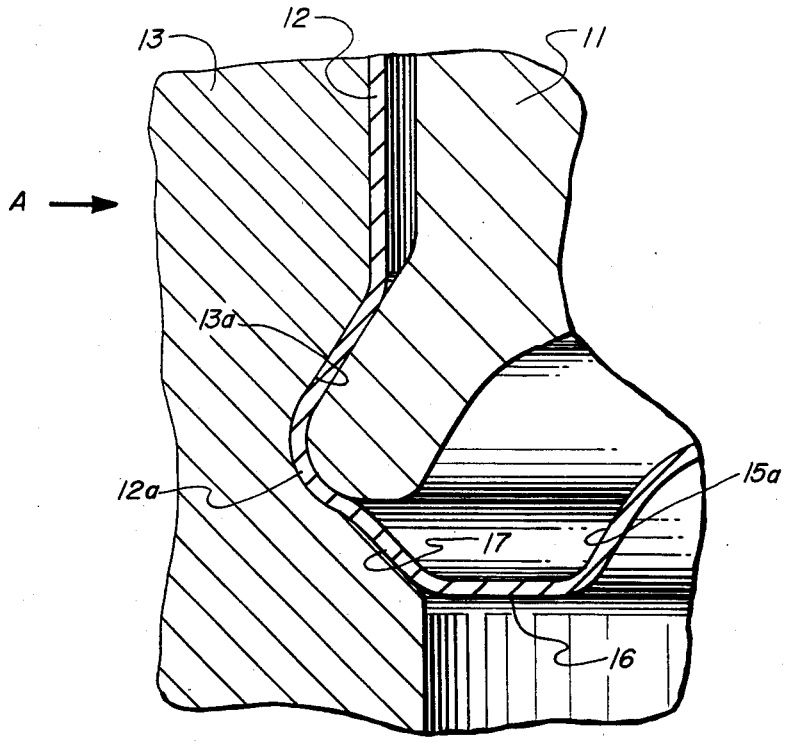
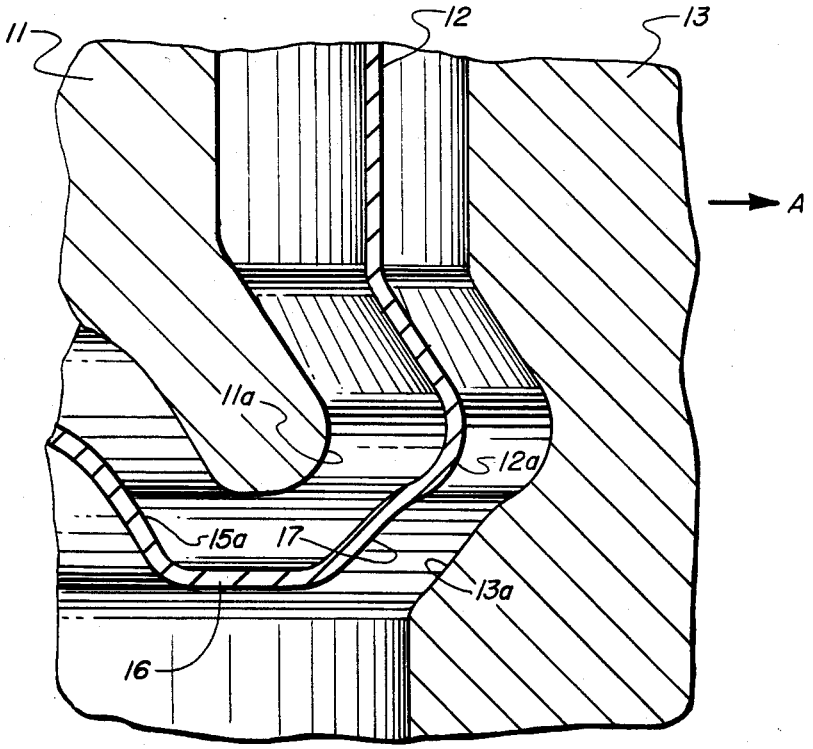
FIG. 4

FIG. 5
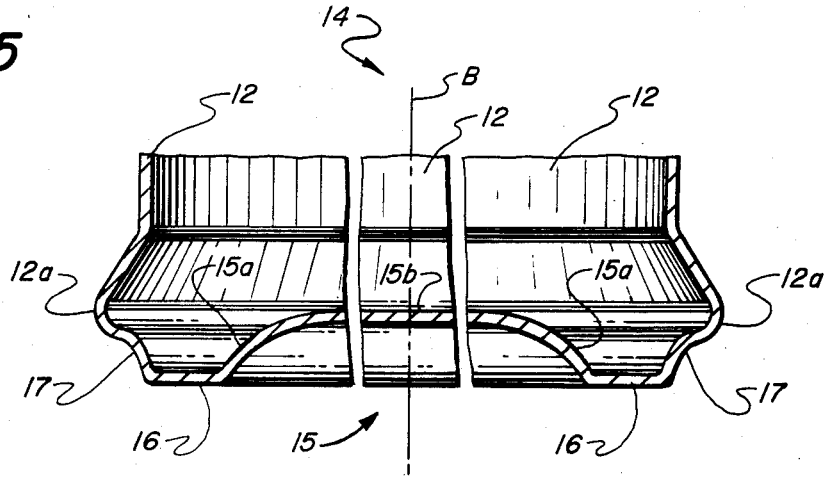
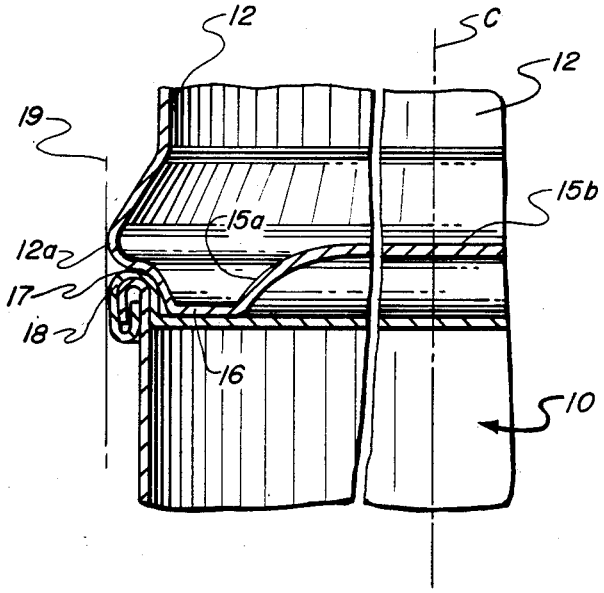
FIG. 6

BOTTOM PROFILE FOR A SEAMLESS CONTAINER BODY

RELATED APPLICATIONS

This is a Continuation application of pending prior application U.S. Ser. No. 120,399, filed Feb. 11, 1980, now abandoned.

BACKGROUND OF THE INVENTION

This invention relates to can ends and more particularly to the bottom end of a two-piece drawn steel food container which is designed to be packed and then processed at high temperature and pressure in a retort. More particularly, in a can where the contents are to be heated above their boiling point and then cooled, the bottom end is subjected to internal pressure and then external pressure. Each sealed container must be retorted to prevent bacterial growth and spoilage which will generate metabolic products such as organic acids and carbon dioxide; the latter tending to inflate the sealed container causing it to bulge or become unseamed. In order to have commercial sterility (safety) the food must be heated to a state which renders it free of viable forms of micro-organisms which are there or which would reproduce in the future under normal storage conditions. A certain group of high acid foods need not be retort processed, but these acidic foods are hot packed. That is to say that, they are heated to near the boiling point and then packed in the container. Even hot packing places considerable stress on the container. The combination of the hot fill and the acid is equivalent to retort sterilization of low acid level foods. Foods with a pH level of 4.6 or higher must be retorted in order to achieve commercial sterility.

In the past it has been the practice to use heavy gauge high strength metal to resist the processing stresses in a double seamed on bottom end for a three-piece container e.g. 85 lbs per base box plate. In general, the three-piece container is less satisfactory because it costs more, it may require soldering, it produces a needlessly heavy container, it is subject to side seam and double seam leaks and it is wasteful of energy and resources. More process steps are necessary during the fabrication of a three-piece container. More particularly, such containers include on their ends a deep chuck countersink for strength and chuck clearance, and such a countersink is subject to buckling during processing.

A two-piece can with an integral bottom does not require a bottom end chuck countersink for double seaming, but a bottom recess is necessary in order to manufacture a two-piece can with the same height and capacity as a conventional three-piece can so that either may be interchangeably used in the same packing and processing line. Profiling has been used to apply ribs, creases and the like to add rigidity to the bottom of a two-piece can. The weakest area of a drawn two-piece can is the bottom and consequently, the material thickness of the steel is a function of the bottom strength required (buckle resistance). With only moderate profiling, the pressurized two-piece can bottom may tend to distend and exceed the elastic limit of the metal. When that happens the can is unacceptable as it will rock about its distended bottom and appear to contain tainted or spoiled contents.

Consequently, a bottom recess can improve the performance of thin-two-piece cans if such a recess is designed to include work hardened areas of metal which increase the elastic limit of the bottom metal particularly in areas of high stress. The highly worked bottom is more rigid. Spoiled contents will tend to force outward the top end and simplify the process of checking the packed cans. The present invention achieves the desired rigidity and especially internal pressure resistance at the bottom of a two-piece can as a result of specific and cooperative profiling relationships wherein further appropriate work-hardening prevents highly undesirable eversion of an inwardly domed bottommost configuration.

The large capital investments in equipment for handling three-piece cans in the packing plant cannot be merely written off. A two-piece container which will physically resemble the three-piece container is essential in order to permit continued use of the existing three-piece equipment, e.g., labelling, runways, retort, etc. The 100% interchangeability is recognized in the patent art, see, for example, U.S. Pat. No. 3,912,109 which discloses an approach and several methods of making same. Similarly, see U.S. Pat. No. 3,272,383 which discloses an extruded aluminum can with a recessed bottom profile. Such prior art is typical in its emphasis on duplicating the shape of the three-piece can but fails to teach a container which is of adequate strength and will protect food without corrosion and move through customer's equipment. For economy and high-speed production a drawn two-piece can made of coil coated metal or subsequently coating a drawn and beaded container should be at the bottom of the can. It is very difficult to form a chime-shaped bead without damaging the inside coating surface. More particularly, the use of internal tools to form a chime-shaped bead is detrimental to the coating. In the present invention, the forming of a simple bead of prescribed shape is moderate by comparison and prevents undue loading by the inside tools necessary to form a chime-shaped bead. Consequently, the danger of scuffing and sharp bends in reforming which would crack the inside coating is completely eliminated because there is sufficient space inside the bottom can corner to operate a beading tool.

Since drawn two-piece containers offer numerous advantages particularly in the elimination of the side seam and one end seam, it is commercially important that the bottom profile formed in accordance with the preferred method and shape also be able to withstand a retort temperature of 260° F. for thirty minutes or more, and yet be interchangeable in all respects with the three-piece container which from time to time may have to be used on the same package and processing designed so that the interior coating remains intact even though the bottom is deeply recessed and formed to include a chime-like bead to provide rolling in the trackwork and through the labeler and other food packing and processing equipment. The prior art teachings show chime-shaped beads.

It is, therefore, an object of the present invention to provide a two-piece can bottom profile which is resistant to ultimate stress by improving the elastic limit of the can material particularly in the bottom.

It is yet another object of the invention to provide a sidewall bead, located just above the corner between the bottom and wall, that will have a prescribed shape and an overall outer diameter essentially equal to outer diameter of the top double seam of the closed container.

It is still another object of the present invention to provide a bottom profile and lower sidewall bead which will allow two-piece cans to be run interchangeably with conventional three-piece cans, such that the processing speed of the two types of containers are essentially the same.

It is an object of the invention to provide a bottom profile and method for forming same which will not destroy the integrity of the coated interior.

It is a further object of this invention to provide a two-piece container of a low cost efficient light gauge coated metal which is capable of resisting buckling caused by heating pressures incurred during retort processing and cooling and which is able to withstand crush loads imposed by stacking.

SUMMARY OF THE INVENTION

The profile design concept which permits the objects to be realized is found in a press forming process where the profiling is accomplished in the final drawn die at the bottom of the stroke, in a draw/redraw press. At that stage the bottom profile has all the essentials of the final desired profile including a central recess. The drawn can bearing the preferred profile shape has an annular flat outer circumferential portion extending from the lowermost bottom corner of the sidewall inwardly to an upwardly and inwardly inclined annular wall concentrically located relative to the central longitudinal axis of the can. The annular wall tips slightly toward the axis and extends inwardly towards the circumferential portion forming the boundary of the central domed recess. The central recess is essentially parallel to the bottom plane defined by the aforesaid flat circumferential portion in that the same forms a relatively shallow and long-radius dome and is formed by doming inwardly along the axis. The resulting bottom profile maximizes the work hardening by increasing the elastic limit of the bottom metal in the areas likely to buckle whereby the strength (buckle resistance) is improved. Similarly, the domed central recess acts in cooperation with the annular wall whereby sufficient internal pressure causes the inclined wall to flex away from the axis, and in a spring-like fashion resist the tendency of the dome to pop outward.

The profile as described is applied during a draw/redraw of the precoated steel and forms the bottom of an essentially straight sidewall container. Such a container is then sent to the beading machine where the sidewall and bottom (or stacking) beads are applied to the can sidewall. The bottom stacking bead is placed on the sidewall slightly above the plane of the bottom panel (usually commencing about 0.035" above the plane of the can bottom. A beading mandrel may be placed inside the can and operates to form the outwardly disposed stacking bead without scuffing or scraping off the bottom interior coatings and making the container vulnerable to corrosion. The position of the annular wall allows ample room for beading at a very low level along the sidedwall. It is important that the bead be located just about where the center of a regular lower chime would be on a three-piece can; this is because the tracks that guide and carry cans through a continuous retort will develop wear grooves at the place across which the chimes ride. A simulated chime-shaped bead, while having the dimensions of a chime, will not necessarily follow the groove as accurately as the low level bead herein described. That is to say that, it is easier for a smaller bead to follow the larger groove than a chime-shaped bead to follow a chime worn groove. Similarly, the position of the bead relative to the sidewall is important. A bead which is located more nearly at the level where the top of a chime might be, is likely to interfere with the chime worn groove whereas a low level bead is sure to fit more centrally within the chime worn groove.

The metal working of the bottom panel which provides the central recess is done in such a manner that the amount of material in the blank need not be increased. More particularly, the central recess is formed substantially from stretching the metal from the bottom panel and as such has little or no bearing on the sidewall length or remaining flange of the drawn container. This is beneficial from the standpoint of economical material usage and is important from the standpoint of work hardening only the bottom to improve the elastic limit of the bottom panel. The formed central recess may have Luder's lines which indicate that a level of stress 1 to 2%, i.e., metal working has taken place such that the overall strength is increased.

The completed can has identical height and capacity (volume) when compared to a conventional three-piece can. Consequently, the same height label as used on a three-piece can is usable and similarly this two-piece can configuration will roll smoothly through any labeler and processing or trackwork designed for three-piece containers due to the same rolling diameter at both ends. For purposes of high-speed production and the diminution of subsequent post spray treatment it is preferred that the metal for this two-piece can body be drawn from a precoated stock. More particularly, steels such as TFS-CT or ETP, the latter having from 10 to 125 pounds per base box of electrolytically deposited tin work well. The tinplate would be continuously cast, continuously annealed aluminum (or silicon), killed or rimmed and stabilized ingot cast steel. Steel thickness from 55 pounds per base box up to 85 pounds per base box with a temper of T-1 to T6 single reduced plate or double reduced plate of DR-7 through DR-9 can be used. The preferred embodiment is a T-4 steel of the TFS-CT type. Such a material is precoated with an epoxy phenolic exterior surface (of can body) to prevent corrosion and an organosol interior surface (of can body) to protect the metal from the foods which will ultimately be packed and processed in the container. The precoated metal is fed into a press in which it is blanked, cupped, drawn and redrawn into a can-like cylindrical shape having a side and integral bottom wall. The side length being almost twice the diameter of the can body. It has been found that the work hardening of the bottom during profiling will raise the hardness of the T-4 steel approaching the level of DR-9 double reduced steel. Consequently, the container has the requisite strength across the bottom and in the lower bead, but is formed from the easier to work with 75 pound T-4 steel. If the metal used for drawing cans is 65 pound DR-9 plate even with a reduced countersink depth buckle strength would remain the same. Some penalty in extra power would be required to form each can.

DETAILED DESCRIPTION OF THE DRAWINGS

Figure 2:
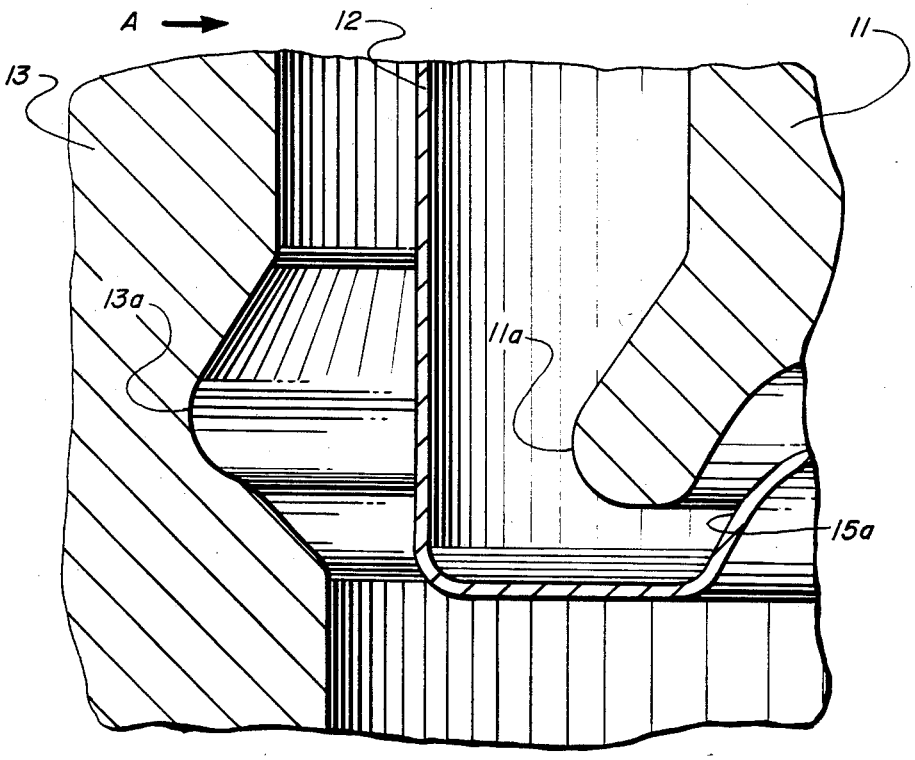
FIG. 2 is a partial fragmentary enlarged sectional view of the lower corner of the container of the present invention showing the beading tool entering the container wherein the axis and the container and the tool are in line with one another.

FIG. 3 is similar to the view of FIG. 2 and shows the beading operation wherein the container is run over by means of a female die to the beading tool by moving the axis of the container with respect to the axis of the beading tool, and FIG. 4 is like the view of FIG. 3, but shows the opposite side of the container and beading tool and particularly the clearance between bead tie and the center recess.

FIG. 5 is a partial cross-sectional view of the entire bottom profile;

FIG. 6 is a partial cross-sectional view showing the stack relationship between the double seam below and the preferred bottom wall profile of the present invention.

Figure 7:
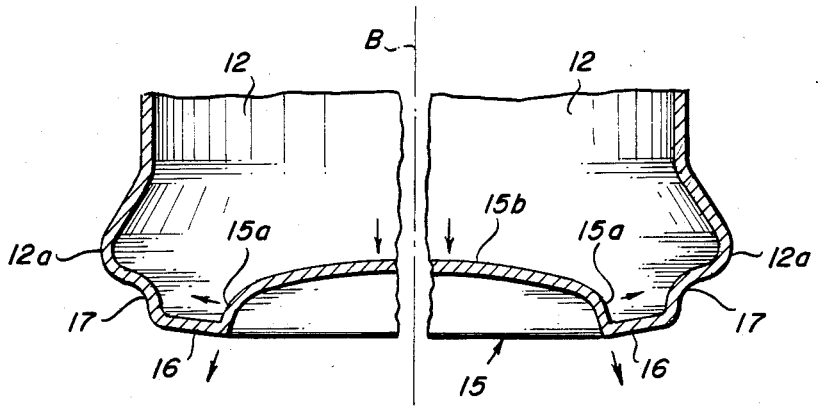
Figure 8:
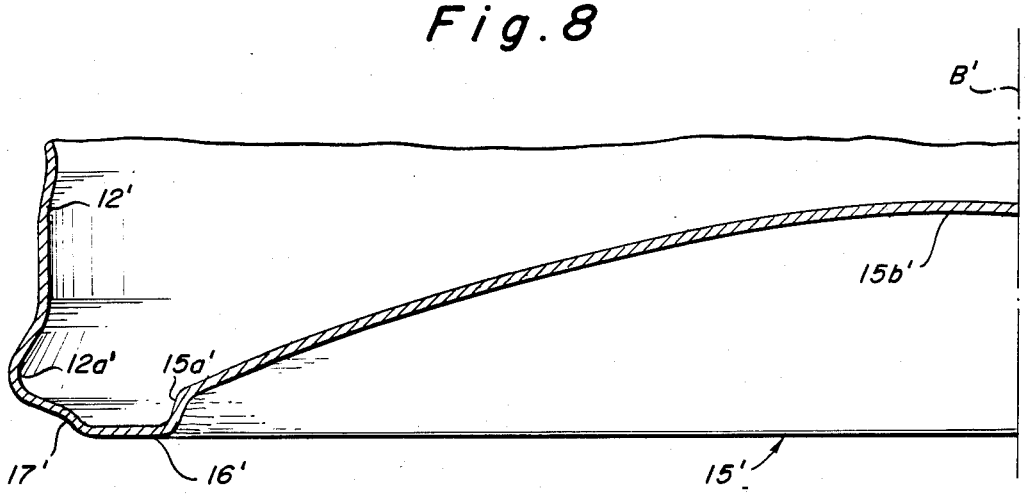

FIG. 7 is a view similar to FIG. 5 illustrating in an exaggerated fashion for clarity the relative movement of the bottom profile under substantial internal pressure; and FIG. 8 is an enlarged partial cross sectional view of one-half of a bottom profile formed in accordance with the invention

DETAILED DESCRIPTION OF THE DRAWINGS

Figure 1:
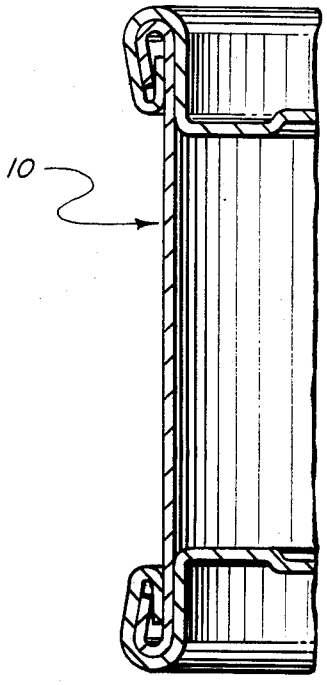
FIG. 1 PRIOR ART
FIG. 1 is a partial elevational view of a prior art three-piece container having double seamed top and bottom ends.

FIG. 1 is a side partial cross-sectional view of a prior art three-piece container 10 used to pack comestibles. Such containers are formed of a body rolled into a tube and seamed along a longitudinal side and two ends which are double seamed to the tubular hollow body. It is desirable that the side seam be eliminated and the weight and labor penalties of the additional double seamed end be removed. Therefore, considerable effort has gone into the development of a drawn hollow two-piece container to which an end may be double seamed. This is referred to as a two-piece sanitary can, and such containers are usable for packing comestibles. They are more compact, in terms of material usage and cleaner in terms of number of seams per container.

Efforts to make such containers which are totally interchangeable with the prior art three-piece container have met with many difficulties. The most important of which, relative to this invention is the ability to form a lower chime-like bead which will act to replace the lower chime in a prior art three-piece container. Such a bead has to perform a number of functions. More particularly, the bead has to have the same diameter as the upper chime of a doubled seamed container whereby the complete two-piece container will roll without cocking in the trackwork and processing equipment. Similarly, the lower bead has to provide a space for the labeling. That is to say that, the distance along the side wall between the top part of the lower bead and the bottom parts of the upper chime has to be equal to that between the two double seam chimes of a three-piece container. In addition, the lower bead has to function similar to a chime in that it must provide increased strength for abuse resistance and aid in rolling and stacking processed containers.

The improvement herein is two-fold being the particular lower bead which substitutes for the chime and the overall can profile (bottom and lower side wall) which permits an appropriate bead to be formed without destroying the inside surface of the container or the overall buckle strength of the bottom. The container is formed of a precoated stock which is blanked and drawn and redrawn into the finished container. Just before all of the drawing is complete, a specific bottom profile is provided which gives the necessary bottom recess and imparts the requisite bottom strength. The recess provides the same internal volume in a two-piece container as that of a three-piece container. Profiling is also required to improve the overall bottom strength by work hardening metal. Sanitary cans for comestibles must resist internal and external pressures to which they are subject during processing. The bottom recess configuration is specifically selected to do that. Buckle pressures up to 44 psi are realized. Previous recessed integral ends achieved less than 33 psi buckle pressure a 35% increase in buckle resistance.

Turning now to FIG. 2, a beading tool 11 is shown entering the container to the depth at which the bead is to be produced. Tool 11 has a bead nose **11*a* which is shaped in the preferred configuration including a generally frustoconical upper portion and acts to form the container with a lower chime-like bead. The tool 11 enters the can concentrically with respect to the container. That is to say that, the tool 11 is cylindrical and has its central axis in line with the central axis of the container 12 upon the entry of the tool into the container 12, same being as formed in the draw/redraw operation. The container 12 is carried in a beading machine which includes an eccentrically movable female beading die 13 positioned outside of the container 12 and moved in the direction A, shown by the arrow 3 in FIGS. 3 and 4. Female beading die 13 includes a complementary beading surface 13*a* whose upper portion inwardly of the outermost extent of bead 12*a* is substantially frustoconical and which cooperates with the surface 11*a* of the tool 11**.

In operation, the beading die 13 is eccentrically moved toward the container 12 left to right in FIG. 3, whereby the container 12 and the tool 11 which are rotating will be caused to roll against the female die 13. In a manner well known in the industry, the bead **12*a* is thus formed by rolling into the lower side wall of the container 12, see FIG. 4. While the technique for rolling beads is well known, the particular bead 12*a* and its location of the present invention are not. The reason for this is that heretofore, it has been difficult to provide a bead 12*a* of the desired configuration and location in a container 12 having the requisite bottom recess without damaging the internal surface, of a container. More particularly, space for the beading tool 11 is necessary so that there is clearance between the bottom inside of container 12 and the tool 11. In FIG. 4, clearance between the tool 11 and the bottom recess is shown during the beading operation shown in FIG. 3. Such clearance is a function of the bottom profile shape. If the container 12 were to have a shaped bead which was of chime shape for interchangeability, and the container had a recess bottom for strength and volume, the beading tool would not be able to enter the space provided without damaging the inside surface of the container or destroying the tool. A thin tool wall would be needed and same would be fragile. Consequently, a combination of bead shape and recessed configuration are necessary to permit the formation of a lower bead 12*a* which is chime-like but not chime-shaped. In addition, the bead 12*a* must be of a depth which will make the lower can wall the same diameter as the double seamed chime. The lower bead 12*a* of the present design has been found to give increased overall can strength and more particularly, the work hardening of the bead 12*a*** during the forming raises the vertical crush strength of the finished and packed can a measurable percentage being 10% greater than a similar can with a chime shaped bead. Similarly, the abuse resistance of the bottom corner of the can is also increased by 30% over a more chime-shaped bead located near the can bottom.

As shown in FIG. 5, the overall lower wall and bottom profile 14 includes a recessed center section generally designated 15. The center section includes an annular inner wall 15*a*, which is substantially straight but tipped inwardly at its upper end toward the central axis B of the container 12, and the shallow dome at 15*b*. The wall 15*a* is connected across its top by the shallow dome shaped portion 15*b* which is of even curvature and, the wall 15*a* is connected at its bottom to the inner edge of a flat rim ring 16 which faces outwardly with respect to the container bottom. Rim ring 16 is planar and represents the axially outwardmost portion of container 12 bottom i.e., the part upon which the container rests when standing in an upright position. Between the outer shape of rim ring 16 and the bead 12*a* is a relief section 17 which is formed by the beading die 13*a* during the beading operation.

Relief 17, as shown in FIG. 6, is designed to cooperate in stacking relationship with upper double seamed end 18 of a similar container. Consequently, any container having the same overall outside diameter are stackable relative to one another by means of the top portion of a double seamed end 18 fitting within the relief 17 when the central axes C of the two containers are in alignment with one another, see the side line 19 in, FIG. 6.

FIG. 8 illustrates on an enlarged scale a half-section of a bottom profile from the center line B' radially outwardly of a preferred container wherein the relationship of the illustrated components correspond proportionally to the dimensions hereinafter noted. Thus, with respect to FIG. 8, in a preferred embodiment, the container 12' is 3 3/16" in diameter and the center of the bead 12*a'* is 0.1" above the plane of the bottom rim ring 16' and the overall bead height is 0.18" above the plane of the bottom ring 16' whereby were the can to be labelled the bottom edge of the label would rest between the area at which the bead starts which is 0.18" above the bottom and the lower end of the upper double seam 18'. The bead extends approximately 0.05" outwardly from the wall of the container 12'. This is an amount which will increase its diameter to approximately the diameter of the upper double seam. The combination of the height of the bead center and the distance to which it extends will place the bead 12*a'* squarely within any chime worn grooves in the trackwork or processing equipment. The radius of the beading tool nose at 11*a'* is approximately 0.04" and the external radius formed by die 13*a'* at the point 0.18" above the bottom where the container wall 12' bends outwardly to form the bead is approximately 0.030".

In FIG. 8, the annular wall 15*a'* is connected to the dome-shaped center section 15*b'* by a section with a radius of 0.070". Similarly, the ring shaped section 16' joins the annular wall 15*a'* with a radius of 0.07". The overall radius of curvature for the domed center portion 15*b'* *is* 3" and the height at the center of the container 12' of the recess domed center portion 15*b'* *is* 0.390" above the bottom plane of the container as established by the flat rim ring 16'. The annular wall 15*a'* tips inwardly at an angle of about 10° with respect to the vertical.

For purposes of stacking the relief section 17 has a radius of curvature of 0.03" whereby the upper portion of the double seam 18, FIG. 6, will rest relative to the relief 17 if the containers are of similar diameter and are vertically and axially aligned relative to one another.

It has been found that a container 12' of the preferred diameter will take the processing temperature incurred during retort sterilization of a sealed container. That is to say that, such a container or with the described bottom profile will withstand up to 44 psi of internal pressure without the bottom buckling outwardly or everting. More particularly, the center recess portion 15 will maintain its configuration and the growth during sterilization will be at the flat ring 16 which tends to bow outwardly near the annular wall 15*a* by pivoting somewhat relative to the point at which it joins the relief section 17. In connection therewith, as noted earlier, the annular wall 15*a'* will flex slightly outwardly in a direction away from the central longitudinal axis B', thereby enhancing the resistance of the domed central area 15*b'* to alter its configuration to pop outwardly or evert. These relationships are shown in somewhat exaggerated fashion in FIG. 7 which shows the container under substantial internal pressure as compared to the unstressed form thereof in FIG. 5. Thus, the relative pressure has caused slight flexing of ring 16 with relative pivoting at its point of juncture with relief section 17 and wherein further the shallow dome 15*b* has substantially maintained its configuration in slightly flattening, while the wall 15*a* has relatively pivoted outwardly with respect to the center line B. The small arrows in the figure illustrate the relative directions of movement in FIG. 7 as compared to the structure of FIG. 5. As indicated, the shallow dome 15*b* is connected to the annular wall 15*a* by a radius area which in the illustrative example of FIG. 8 may be on the order of 0.070 inches.

As a consequence, pressure on the relatively extensive surface area of the dome 15*b* (or 15*b'*) in accordance with the invention causes the slight flexing of the annular wall 15*a* in a radial outward direction, which spring-like action produces substantial forces resisting further deformation, flexing or pop-out eversion of the dome 15*b*. This is achieved notwithstanding the relatively lightweight or thin gauge of the material and contrasts with prior practice wherein relatively massive structural members were employed to prevent unwanted distortions as a result of internal as well as external pressures. The slight eversion of the dome usually is removed when the cans are cooled after processing, due to internal can vacuum.

While the invention has been disclosed with respect to the accompanying drawings, as well as with respect to certain exemplary dimensioning, it is to be understood that other and different forms and configures of the bottom profile of the invention may be fabricated within the scope of the instant disclosure and as defined by the claims to the invention set forth hereinafter without departing from the spirit and concept of our invention.

What is claimed is:

1. In a two-piece metal can having a seamless container body of generally circular cross-section about a central longitudinal axis and formed of a thin material into an integral cylindrical sidewall and bottom wall, the body adapted to receive a top closure to be joined to the sidewall at the upper end thereof opposite the bottom wall by an annular double seam having interfolded adjacent layers of metal, the improvement being (1) in the profile of the said sidewall at the lower portion thereof adjacent to the intersection thereof with said bottom wall, and, (2) in the profile of the area of the bottom wall thereat comprising:

(a) in said sidewall lower portion, (i) a radially outwardly extending bead increasing the diameter in said lower sidewall portion just above and in spaced relation to said intersection with said bottom wall so that the radially outermost portion of said bead is disposed slightly above said bottom wall, and, said bead above said outermost portion has a substantially frustoconical configuration tapering upwardly and inwardly toward said sidewall thereabove at an acute angle to the container axis;

(ii) an outwardly facing annular inwardly curved relief section extending between said bead and said bottom wall intersection, said relief forming a groove about the bottom perpiphery of said lower side wall section, and, (b) in said bottom wall portion, (i) a substantially flat and rigid ring-shaped section extending generally normal to said container sidewall and including the axially longitudinally outwardmost plane of said container bottom wall, said ring section having its radially outer edge at said side wall intersection and having an inner edge;

(ii) an inner substantially rigid annular wall extending into the container from said inner edge of said ring section and generally convexly inclined toward the central longitudinal can axis at a relatively sharp acute angle thereto; and, (iii) a recessed and inwardly domed central panel connected at its outer periphery to said annular wall, said panel being formed to be resistant to flexure and change of configuration in response to internal pressure while said flat ring-shaped section pivots about said intersection and relative to said sidewall and while said inner annular wall flexes slightly outwardly with respect to said central axis about the juncture between said annular wall and said ring section inner edge, thereby to accommodate excess internal pressure against said bottom wall;

the said lower sidewall portion at said frustoconical bead and said relief groove, said bottom wall, said inner annular wall, and domed central panel thereby together defining an internal well within said container the profile of which enhances the strength of the container body thereat.

2. The can of claim 1 wherein said annular relief is adapted to cooperate with a double seamed end in mating engagement when the central axis of two cans are aligned in head-to-bottom relation as during stacking.

3. The can of claim 1 wherein said recessed central panel is displaced axially inwardly to the extent required to establish the ultimate internal volume of the sealed container at an amount equal to that of a similarly exteriorly sized three-piece container and the metal of said bottom is stretched sufficiently to raise its elastic limit.

4. The can of claim 1 wherein said well profile is adapted for receiving a beading tool arranged to clear said inner annular side wall to prevent the interior surface from contact with all but the forming portion of the beading tool.

5. The can of claim 1 wherein said most diametrical extent of said lower side wall bead is identical to the most diametrical extent of an end double seamed onto said body forming said annular double seam to hermetically seal said container body.

* * * * *